United States Patent [19]

Cagle

[11] Patent Number: 4,535,752

[45] Date of Patent: Aug. 20, 1985

[54] FIREPLACE CROSS-CIRCULATING AIR HEATER

[76] Inventor: Bunyan B. Cagle, 1700 Towson Ave., Fort Smith, Ark. 72901

[21] Appl. No.: 417,708

[22] Filed: Sep. 13, 1982

[51] Int. Cl.[3] ..... F24B 7/00

[52] U.S. Cl. ..... 126/121; 126/131; 126/139; 237/51

[58] Field of Search ..... 126/121, 129, 130, 131, 126/138, 139, 67; 237/51

[56] References Cited

U.S. PATENT DOCUMENTS

| | | | |
|---|---|---|---|
| D. 252,316 | 7/1979 | Cagle . | |
| 3,930,490 | 1/1976 | Lassy et al. . | |
| 3,942,509 | 3/1976 | Sasser . | |
| 3,955,553 | 5/1976 | Soeffker . | |
| 4,008,703 | 2/1977 | Allgood . | |
| 4,010,729 | 3/1977 | Egli . | |
| 4,019,492 | 4/1977 | Rush . | |
| 4,060,196 | 11/1977 | Goldsby et al. . | |
| 4,074,681 | 2/1978 | Whiteley . | |
| 4,114,590 | 9/1978 | Frahm . | |
| 4,149,671 | 4/1979 | Cagle . | |
| 4,161,168 | 7/1979 | Cagle . | |
| 4,170,218 | 10/1979 | Hartley . | |
| 4,185,611 | 1/1980 | Johnson . | |
| 4,191,161 | 3/1980 | Kling . | |
| 4,197,829 | 4/1980 | Pierce . | |
| 4,206,744 | 6/1980 | Mahoney et al. . | |
| 4,219,005 | 8/1980 | Boahn . | |
| 4,228,784 | 10/1980 | Malafouris . | |
| 4,257,390 | 3/1981 | Synan | 126/121 |
| 4,258,879 | 3/1981 | Nischwitz | 126/121 X |
| 4,305,373 | 12/1981 | Martenson | 126/123 X |

*Primary Examiner*—Larry Jones

*Attorney, Agent, or Firm*—Anthony A. O'Brien

[57] ABSTRACT

A fireplace heater has a pair of pluralities of heat exchanger tubes passing air in opposite directions across a fireplace. A first plurality of the heat exchanger tubes passes air from a left blower and duct means to a right duct means which discharges the air on the right side of the fireplace. The other plurality of heat exchanger tubes pass the air from a right blower and duct means to the left duct means which discharges the air on the left side of the fireplace.

6 Claims, 8 Drawing Figures

FIREPLACE CROSS-CIRCULATING AIR HEATER

TECHNICAL FIELD

The present invention relates to forced air fireplace heaters wherein air is circulated through a heat exchanger within a fireplace and then discharged into a room.

DESCRIPTION OF THE PRIOR ART

The prior art, as exemplified in U.S. Pat. Nos. 4,206,744 and 4,219,005, contains several forced air fireplace heaters having pairs of blowers for circulating air through a heat exchanger within a fireplace and then into a room. Fireplace heaters employing fans on opposite sides of a fireplace and discharging air from the opposite side provide for more even heating of air within a room. However, the prior art dual blower fireplace heaters generally suffer from one or more deficiencies such as being relatively complex and expensive, not being readily adaptable to different sizes of fireplaces, etc.

SUMMARY OF THE INVENTION

The invention is summarized in a fireplace cross-circulating air heater including first and second pluralities of parallel heat exchanger tubes for extending horizontally across a fireplace, left and right blowers, left duct means for directing air from the left blower to left ends of the first plurality of the heat exchanger tubes and for directing air from left ends of the second plurality of heat exchanger tubes into a room, and right duct means for directing air from the right blower to right ends of the second plurality of heat exchanger tubes and for directing air from the right ends of the first plurality of heat exchanger tubes into a room.

An object of the invention is to construct an improved forced air fireplace heater wherein air is input from opposite sides and is also discharged from opposite sides in a room.

Another object of the invention is to construct a fireplace air heater which can be readily adapted to different sizes of fireplaces.

One advantage of the invention is that employment of first and second pluralities of heat exchanger tubes across a fireplace wherein air is passed in respective opposite directions through the first and second pluralities of tubes results in a relatively inexpensive heater design with input from opposite sides and output to opposite sides.

One feature of the invention is that left and right duct means provides for directing air into respective opposite ends of first and second pluralities of heat exchanger tubes as well as directing air from opposite ends of the second and first pluralities of heat exchanger tubes into a room.

Other objects, advantages and features of the invention will be apparent from the following description of the preferred embodiment taken in conjunction with the accompanying drawings.

DESCRIPTION OF THE PREFERRED EMBODIMENT

Figure 1:
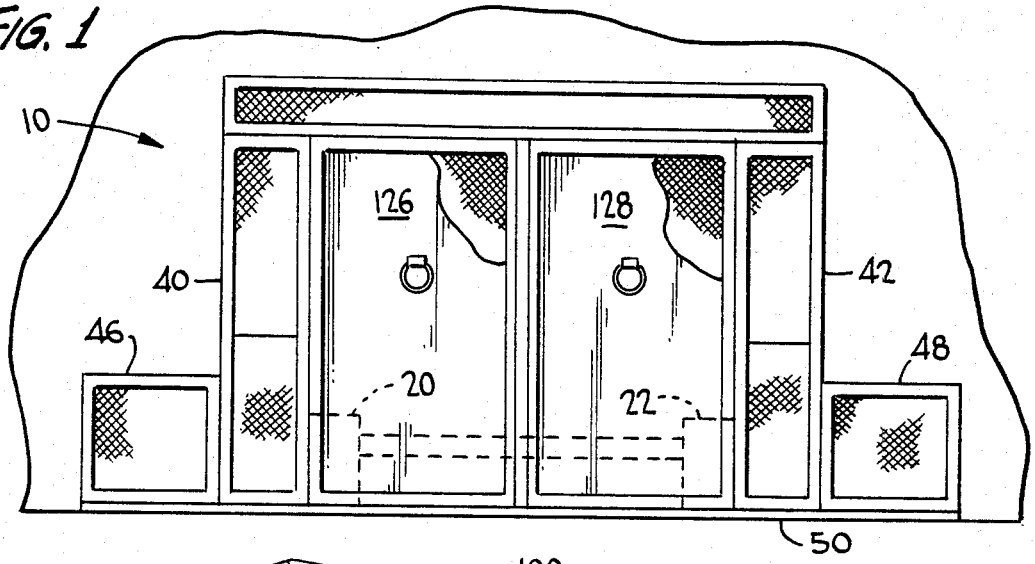
FIG. 1 is a front elevational view of a fireplace cross-circulating air heater in accordance with the invention.
Figure 2A:
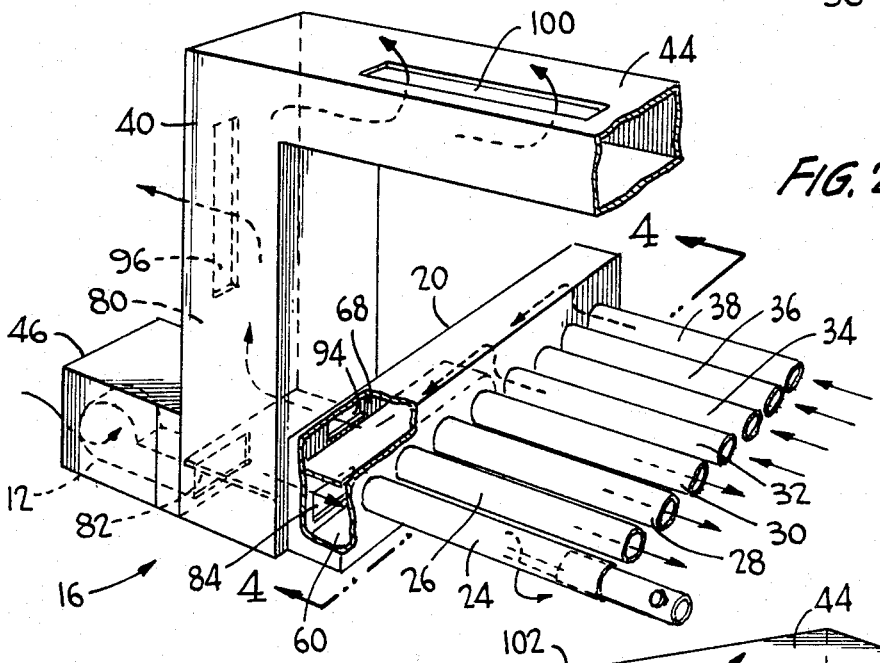
FIG. 2A is a perspective view taken from the front upper right corner of a left interior heater portion broken away from the heater of FIG. 1.
Figure 2B:
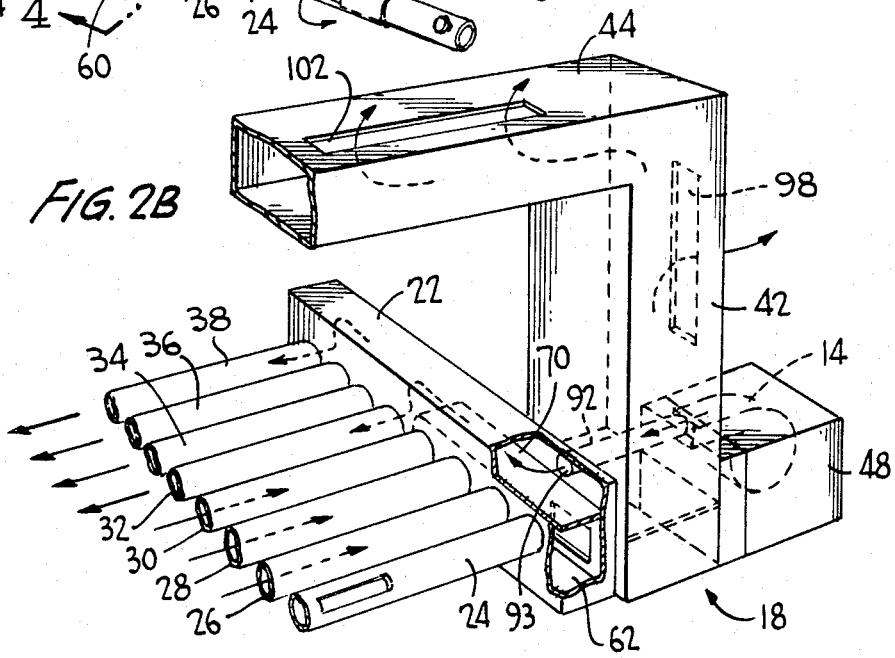
FIG. 2B is a perspective view taken from the upper front left corner of a right inner heater portion broken away from the heater of FIG. 1.
Figure 3:
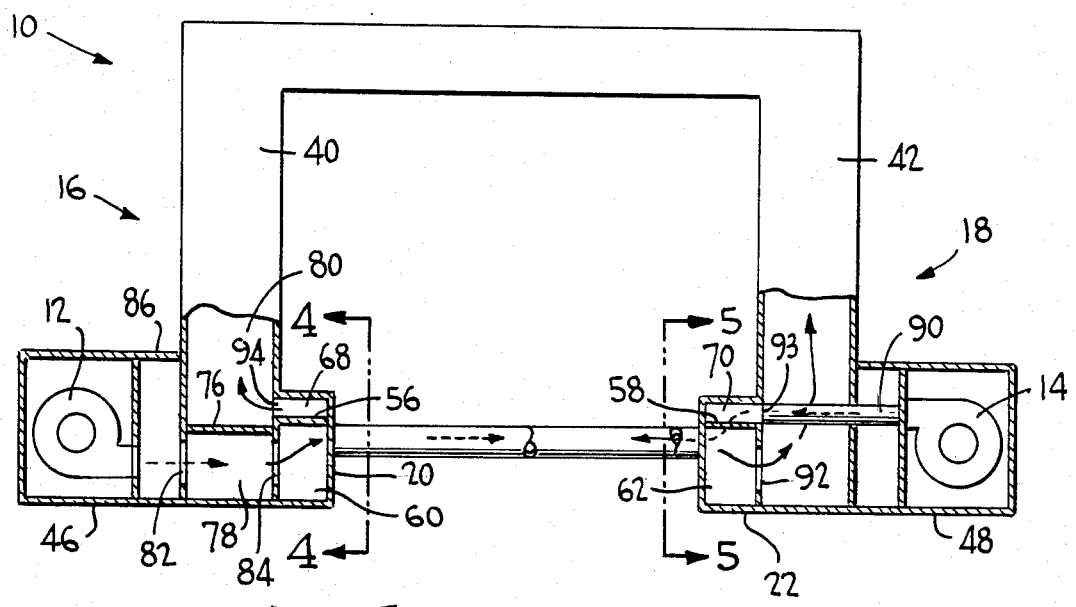
FIG. 3 is a front elevational view of the inner heater portion of the heater of FIG. 1.
Figure 4:
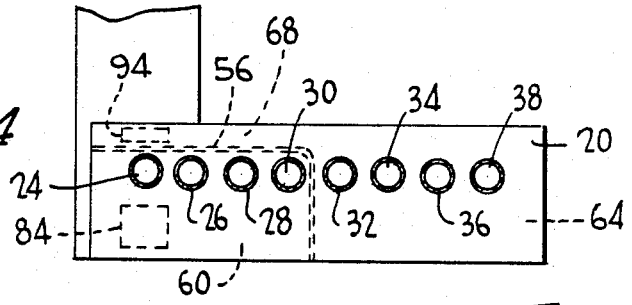
FIG. 4 is a sectional view taken at line 4—4 in FIG. 3 of a left duct portion of the heater.
Figure 5:
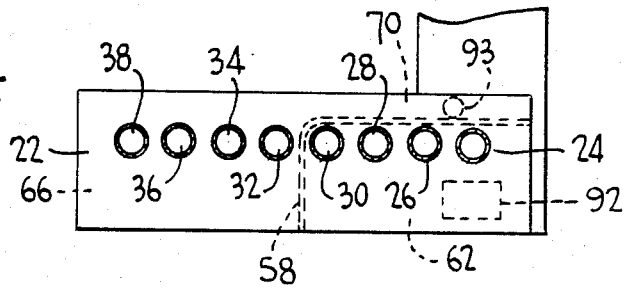
FIG. 5 is a sectional view taken at line 5—5 in FIG. 3 of a right duct portion of the heater.

As shown in FIG. 1, the present invention is embodied in a heater indicated generally at 10 for being installed in a fireplace. The heater 10 as shown in FIGS. 2A, 2B and 3 includes left and right blowers 12 and 14, left and right duct means indicated generally at 16 and 18, and parallel horizontal pipes 24, 26, 28, 30, 32, 34, 36 and 38 for extending across a burning chamber of a fireplace. The pipes 26, 28 and 30 form heat exchanger tubes through which air from the left blower 12 and duct means 16 is driven from left to right exiting into a room through the right duct means 18; and the pipes 32, 34, 36 and 38 form heat exchanger tubes through which air from the right blower 14 and duct means 18 is driven from left to right exiting into the room through the left duct means 16. The frontmost pipe 24 forms a forced air draft for wood, coal, or other material being burned in the fireplace.

The left and right duct means 16 and 18 include respective left and right horizontal ducts 20 and 22 and respective left and right vertical ducts 40 and 42. Forward ends of the horizontal ducts 20 and 22, lower ends of the vertical ducts 40 and 42, and cabinets 46 and 48 supporting the respective blowers 12 and 14 are mounted on a hearth base member 50, FIG. 1, which is designed for extending in front of and to the sides of the fireplace chamber. The lower portions of the ducts 40 and 42 are interposed between the front portions of the horizontal ducts 20 and 22 and the blower cabinets 46 and 48 such that the vertical ducts 40 and 42 extend in front of respective left and right sides of the fireplace and the air blower cabinets 46 and 48 are spaced from the burning chamber of the fireplace. An upper duct 44, at its opposite ends, is connected to and communicates with the upper ends of the left and right vertical ducts 40 and 42. The duct 44 extends horizontally above and in front of the fireplace chamber.

The ducts 20 and 22 extend rearwardly into the respective left and right sides of the fireplace burning chamber along the floor of the burning chamber and support the pipes 24, 26, 28, 30, 32, 34, 36 and 38 in a common horizontal plane spaced a short distance above the floor. Partitions 56 and 58, FIGS. 2A, 2B, 3, 4 and 5, are mounted in the respective ducts 20 and 22 for separating lower front portions 60 and 62 of the respective ducts 20 and 22 from rear portions 64 and 66 and upper front portions 68 and 70; the upper front portions 68 and 70 communicate with the rear portions 64 and 66, respectively. Left ends of the front pipes 24, 26, 28 and 30 communicate with the front lower chamber 60 of the left duct 20 while right ends of the three front heat exchanger pipes 26, 28 and 30 communicate with the front lower chamber 62 of the right duct 22. Right ends of the rear heat exchanger pipes 32, 34, 36 and 38 communicate with the rear chamber 66 of the right duct 22, while left ends of the rear pipes 32, 34, 36 and 38 communicate with the rear chamber 64 of the left duct 20.

Communication from the blower 12 to the lower front chamber 60 of the duct 20 is provided by a partition 76 dividing the duct 40 into a lower portion or chamber 78 and an upper portion or chamber 80. Openings 82 and 84 are formed in the common walls between chamber 78 and a coupling chamber 86 into which the blower 12 discharges and between chambers 78 and 60, respectively. Communication from the blower 14 to the rear right chamber 66 is provided by a conduit or tube 90 extending through the duct 42 and communicating between the outlet of the blower 14 and the upper forward chamber 70 through an opening 91 in the common wall between chamber 70 and duct 42. Lower front chamber 62 of right duct 22 communicates with vertical duct 42 through opening 92 formed in the common wall between chamber 62 and the duct 42. Upper front chamber 68 of the left duct 20 communicates with the upper portion 80 of the vertical duct 40 through opening 94 formed in the common wall between chambers 68 and 80. Side openings 96 and 98 are formed in the upper left vertical chamber 80 and the right vertical duct 42, respectively, and top openings 100 and 102 are formed in the top of the upper horizontal duct 44 for discharging heated air into the room.

Figure 6:
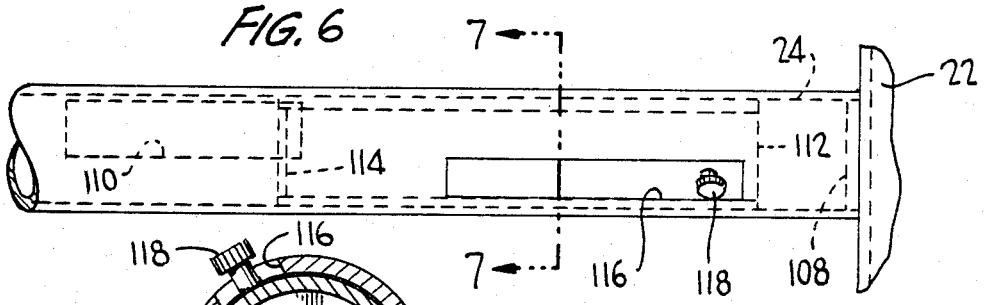
FIG. 6 is a top plan view of a draft control broken away from the heater of FIGS. 1-4.
Figure 7:
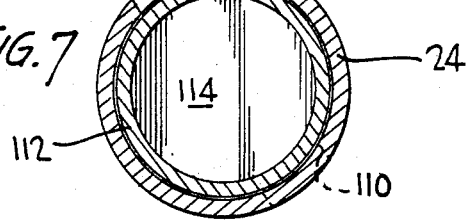
FIG. 7 is a cross sectional view taken at line 7—7 in FIG. 6.

In the variable draft control for the heater as shown in FIGS. 6 and 7, the right end of the pipe 24 is closed by blocking member 108. A downwardly and rearwardly directed horizontal slot 110 is formed centrally in the pipe 24 for directing air from the left blower to the base of a fire. An inner pipe section 112 is slidable within the frontmost pipe 24 and has a blocking member 114 closing the left end of the pipe section 112. The outside diameter of the pipe section 112 is selected to be slightly less than the inside diameter of the outer pipe 24 so that the inner pipe section 112 can be easily slid within the outer pipe 24 but substantially restricts passage of air between the outer surface of the inner pipe segment 112 and the inside surface of the outer pipe 24. An upper forward horizontal slot 116 is formed on the right side of the center portion of the pipe 24, and a knob 118 is mounted on the inner pipe section 112 and protrudes through the slot 116 for sliding the inner pipe section 112 between an open or rightmost position wherein the draft opening 110 is fully open and closed or leftmost position where the draft opening 110 is substantially closed. Intermediate positions of the pipe section provide variable size draft openings.

Doors 126 and 128 are suitably mounted on the front of the heater for closing the fireplace chamber. Also the exposed surfaces of the ducts extending outside of the fireplace can be covered with suitably decorative panels.

In operation of the fireplace cross-circulating air heater shown in FIGS. 1–7, the blower 12 discharges air through the coupling chamber 86, through opening 82 into the lower chamber 78 of the left vertical duct 40, and through opening 84 into the lower front chamber of the left horizontal duct 20. The air passing into the chamber 60 is passed into the left end of the forward pipes 24, 26, 28 and 30. The air in the forwardmost pipe 24 passes through the draft outlet 110 at a rate controlled by the position of the slidable draft closure member 112 to provide air for the combustion of wood or other material in the fireplace. Air in the pipes 26, 28 and 30 passes from left to right into the lower forward chamber 62 of the right horizontal duct 22 and through opening 92 into the right vertical duct 42 which then discharges the heated air through side opening 98 and into the upper horizontal duct 44 where the air is discharged through opening 102.

Air from the right blower 14 passes through conduit 90 into the upper forward chamber 70 of the right duct 22 and then into the rear chamber 66 of the right horizontal duct 22. Air from the chamber 66 passes into the right ends of the rear heat exchanger tubes 32, 34, 36 and 38 and out the left ends of the rear heat exchanger tubes into the rear chamber 64 of the left horizontal duct 20. From the rear chamber 64 of the left horizontal duct 20 the heated air passes via the upper forward duct portion 68 through opening 94 into the upper left vertical duct portion 80. This heated air is then discharged through the opening 96 in the left side of the duct 40 and into the upper horizontal duct 44 where it passes from the top discharge opening 100 into the room.

The employment of two blowers on opposite sides of the furnace heater together with the discharge of heated air from the respective opposite sides of the heater provide for substantially improved air circulation and uniformity in heating of a room. Utilizing forward heat exchanger tubes for passing air from a left blower and duct means to a right duct means which discharges the air on the right side and utilizing rear heat exchanger tubes which pass air from the right blower and duct means to the left duct means which discharges the air on to the left side results in a substantially improved heater for a fireplace with improved cost advantages and economics. The length of the tubes 24, 26, 28, 30, 32, 34, 36 and 38 and the length of the upper horizontal duct 44 can be readily selected for various widths of fireplaces. The tubes 24, 26, 28, 30, 32, 34, 36 and 38 can further serve as the support or grate for wood or other fuel being burned in the fireplace.

Since many modifications, variations and changes in detail may be made to the above described embodiment, it is intended that all matter in the foregoing description and in the accompanying drawings be interpreted as illustrative and not in a limiting sense.

What is claimed is:

1. A fireplace cross-circulating air heater comprising a first plurality of parallel heat exchanger tubes, a second plurality of parallel heat exchanger tubes, said first and second plurality of tubes being disposed coplanar with a horizontal plane and adapted to extend horizontally across a fireplace, left and right blowers, left duct means for directing air from the left blower to left ends of and through said first plurality of tubes, right duct means for directing air from the right blower to right ends of and through said second plurality of tubes, said left duct means including left chambers means receiving air from the left ends of said second plurality of tubes for delivery to a room, and said right duct means including right chamber means receiving air from the right ends of said first plurality of tubes for delivery to the room, said left and right blowers providing input air from opposite sides of the heater and said left and right chamber means delivering output air to reverse opposite sides of the heater.

2. A fireplace cross-circulating air heater as claimed in claim 1 wherein the first plurality of heat exchanger tubes are all positioned in front of the second plurality of heat exchanger tubes.

3. A fireplace cross-circulating air heater comprising first and second pluralities of parallel heat exchanger tubes extending horizontally across a fireplace and being coplanar with a horizontal plane, left and right blowers, left duct means for directing air from the left blower to left ends of the first plurality of heat exchanger tubes and for directing air from left ends of the second plurality of heat exchanger tubes into a room, said left duct means including a left horizontal rearward extending duct supporting and attached to the left ends of the first and second pluralities of heat exchanger tubes, and a partition dividing the left horizontal duct into first and second portions communicating with the respective first and second pluralities of heat exchanger tubes, right duct means for directing air from the right blower to right ends of the second plurality of heat exchanger tubes and for directing air from right ends of the first plurality of heat tubes into the room, said right duct means including a right horizontal rearward extending duct supporting and attached to the right ends of the first and second pluralities of heat exchanger tubes, and a partition dividing the right horizontal duct into first and second portions communicating with the respective first and second pluralities of heat exchanger tubes, the first portions of the left and right horizontal ducts defining lower forward portions of the horizontal ducts, the second portions of the left and right horizontal ducts including rear portions and upper forward portions of the horizontal ducts, the upper forward portions extending above said lower forward portions, the left and right duct means also including left and right vertical ducts having lower portions on left and right sides of forward end portions of the respective left and right horizontal ducts, one of the vertical ducts communicating with the upper forward portion of one of the horizontal ducts, and the other of the vertical ducts communicating with the lower forward portion of the other horizontal duct, a corresponding one of said left and right blowers communicating with the lower forward portion of the one horizontal duct, the corresponding other of the left and right blowers communicating with the upper forward portion of the other horizontal duct, and said vertical ducts having openings communicating with the room.

4. A fireplace cross-circulating air heater as claimed in claim 3 including an upper horizontal duct extending between upper ends of the vertical ducts and communicating therewith, said upper horizontal duct having openings communicating with the room.

5. A fireplace cross-circulating air heater as claimed in claim 4 wherein the left and right blowers are positioned on respective left and right sides of the lower end portions of the respective left and right vertical ducts, said one vertical duct includes a partition forming a lower duct portion of the one vertical duct through which the one blower communicates with the lower forward portion of the one horizontal duct, and a tube extends horizontally through the other vertical duct and communicates between the other blower and the upper forward portion of the other horizontal duct.

6. A fireplace cross-circulating air heater as claimed in claim 3 including a draft air tube in front of and coplanar with the first and second pluralities of heat exchanger tubes, said draft air tube having one end communicating with the lower forward portion of the one horizontal duct and having a central rearwardly directed horizontal air slot and a forwardly directed horizontal control arm slot;

a draft control tubular member slidably mounted in the draft air tube for variably closing the air slot by sliding movement therein; and a control arm attached to the draft control member and extending through the control arm slot for enabling selective sliding movement of the draft control member.

* * * * *